US005797145A

United States Patent [19]

Levinson

[11] Patent Number: 5,797,145

[45] Date of Patent: Aug. 25, 1998

[54] CLOTHING DECORATION

[76] Inventor: Jeffrey A. Levinson, 61 Prince St., #4A, Boston, Mass. 02113

[21] Appl. No.: 713,019

[22] Filed: Sep. 12, 1996

[51] Int. Cl.[6] ..... A41D 27/00; A41D 27/08

[52] U.S. Cl. ..... 2/244; 2/227; 2/79

[58] Field of Search ..... 2/145, 148, 149, 2/150, 151, 152.1, 153, 154, 155, 156, 157, 244, 245, 249, 341, 336, 340, 342, 246, 267, 227, 79; 450/86

[56] References Cited

U.S. PATENT DOCUMENTS

| | | | |
|---|---|---|---|
| 1,830,039 | 11/1931 | Rosicky | 2/150 |
| 2,553,437 | 5/1951 | Burke | 2/150 |
| 2,602,164 | 7/1952 | Di Venuti | 2/153 |
| 2,631,292 | 3/1953 | Cunningham | 2/153 |
| 2,735,105 | 2/1956 | Traub | 2/150 |
| 2,787,002 | 4/1957 | La Piedra | 2/153 |
| 2,999,245 | 9/1961 | Lippman | 2/246 |
| 3,353,190 | 11/1967 | Gaski | 2/153 |
| 3,597,877 | 8/1971 | Speers . | |
| 3,786,520 | 1/1974 | Harmon . | |
| 3,864,791 | 2/1975 | Bishop . | |
| 4,063,313 | 12/1977 | Hagios . | |
| 4,501,026 | 2/1985 | Seneca . | |
| 4,582,744 | 4/1986 | Smyth, III . | |
| 4,587,693 | 5/1986 | Osumi et al. . | |
| 4,817,249 | 4/1989 | Astier . | |
| 4,975,987 | 12/1990 | Teachout et al. | 2/246 |
| 5,035,002 | 7/1991 | Knight, Jr. | 2/148 |
| 5,060,356 | 10/1991 | Szedzinksi . | |
| 5,077,867 | 1/1992 | Messina . | |

FOREIGN PATENT DOCUMENTS

| | | |
|---|---|---|
| 2 618 231 A1 | 7/1987 | France . |
| 41 02 443 A1 | 7/1992 | Germany . |
| 1-184200 | 7/1989 | Japan . |
| 7-16106 | 1/1995 | Japan . |
| WO 93/08712 | 5/1993 | WIPO . |
| WO 93/25104 | 12/1993 | WIPO . |
| WO 96/02159 | 2/1996 | WIPO . |

OTHER PUBLICATIONS

Cindy LaFavre Yorks, "Clips Add Zip", Los Angeles Times, Nov. 29, 1994.

*Primary Examiner*—Jeanette E. Chapman
*Attorney, Agent, or Firm*—Fish & Richardson P.C.

[57] ABSTRACT

A method of decorating an item of clothing uses a decorative device that includes a surface configured to enclose a space, the surface including a gap that permits entry to the enclosed space. A portion of a loop of the clothing (e.g., a belt loop) is manipulated to lie within the space enclosed by the surface, other portions of the loop extending outside the device.

The decorative device includes a generally annular surface having a length between about ½ inch and about 2 inches. The surface is configured to enclose a space having a diameter of at least about 1 inch. The surface includes a gap oriented generally along a length of the surface and permitting entry to the enclosed space, the gap being as large as about ¼ inch.

23 Claims, 4 Drawing Sheets

CLOTHING DECORATION

BACKGROUND

This invention relates to clothing decoration.

Clothing decoration includes an almost endless variety of devices that are incorporated into the clothing during manufacture, such as buttons, stitching, printing, and sequins. Other decorative devices may be added to the clothing after it is made, for example, pins, belts, and buttons. Fashion is typically a strong factor in the type and location of decorative devices that are used on clothing. Fashion is especially important to adolescents and young adults.

SUMMARY

In general, in one aspect, the invention features a method of decorating an item of clothing using a decorative device that includes a surface configured to enclose a space, the surface including a gap that permits entry to the enclosed space. A portion of a loop of the clothing (e.g., a belt loop) is manipulated to lie within the space enclosed by the surface, other portions of the loop extending outside the device.

In some implementations of the method, after the portion of the loop has been manipulated to lie within the space, the device is rotated to reposition the gap to impede removal of the device.

In general, in another aspect, the invention features the decorative device including a generally annular surface having a length between about ½ inch and about 2 inches, and configured to enclose a space having a diameter less than about 1 inch (and, e.g., at least about ⅜ inches). The surface includes a gap oriented generally along a length of the surface and permitting entry to the enclosed space, the gap being as large as about ¼ inch.

Implementations of the invention may include one or more of the following features. The surface may be rigid or flexible, and of metal or plastic. The gap may extend along the entire length of the device. The surface may be generally cylindrical. The surface may include a decorative element, such as color, patterning, fluorescence, metal, sparkles, embossing, a coating such as paint, or fabric. Among the advantages of the invention are one or more of the following. The decorative device is simple and cheap to make and is easy to attach to clothing. It is attractive, noticeable, and unusual in its appearance. A variety of appearances can be imparted to different decorative devices at the time they are made or later.

Other advantages and features will become apparent from what follows.

DESCRIPTION

Figure 1:
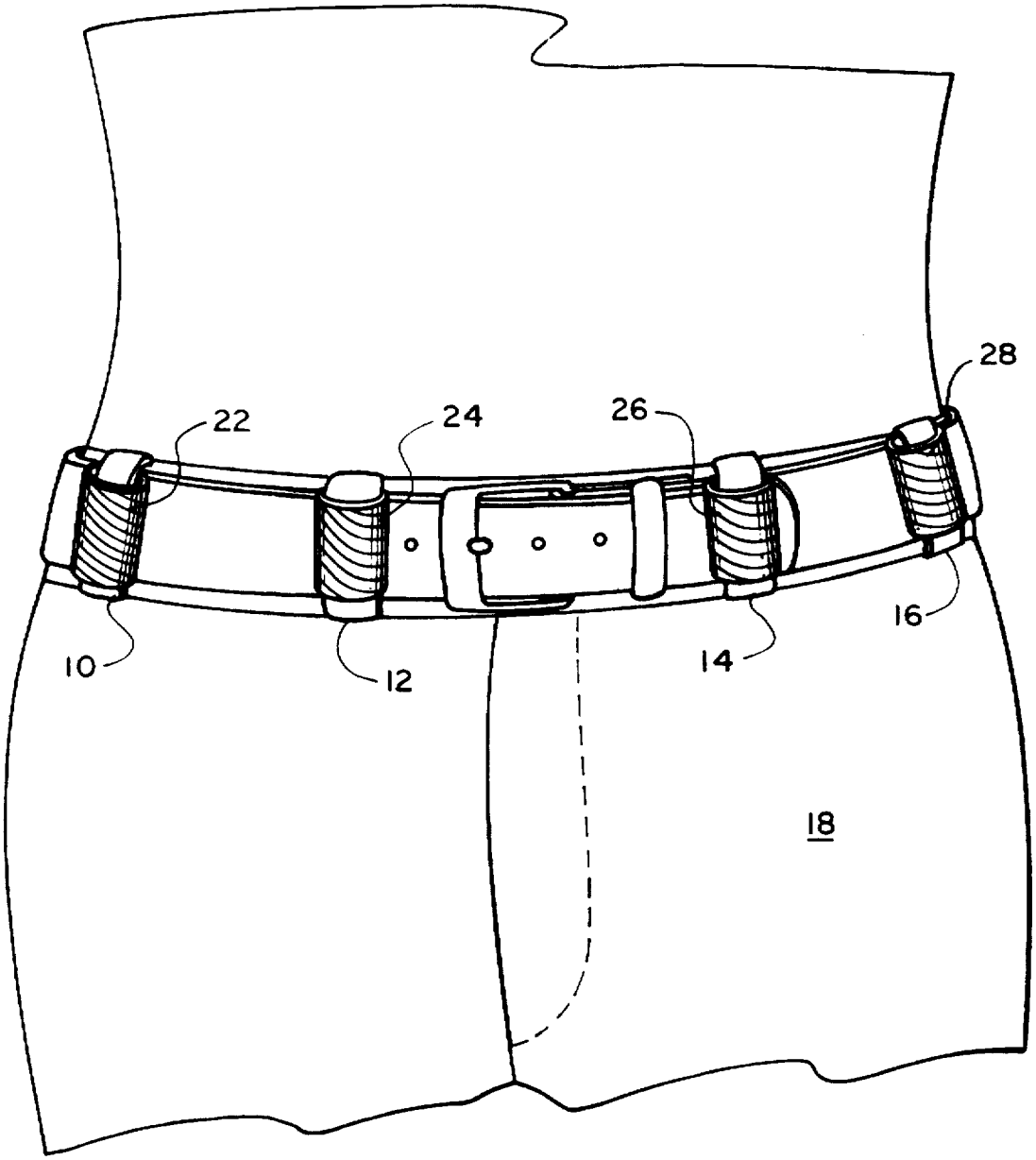
FIG. 1 is a front view of a torso.

As seen in FIG. 1, belt loops 10, 12, 14, 16, on a pair of pants 18, are covered by decorative rigid metal clips 22, 24, 26, 28. Each clip is about 1 inch long and ½ inch in diameter. The metal is about 1/16 inch thick.

Figure 2:
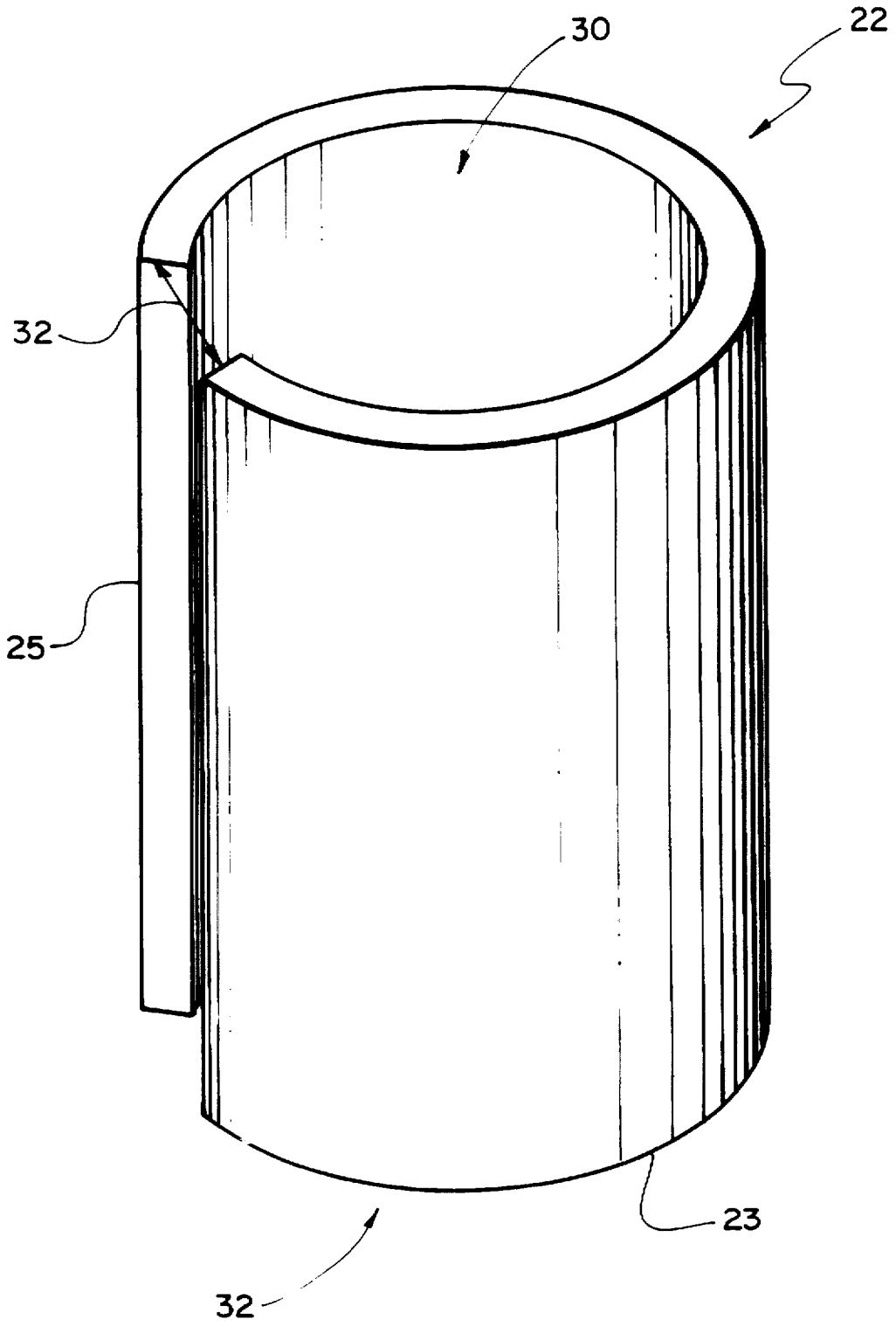
FIG. 2 is a perspective view of a clip.

As seen in FIG. 2, in one example, each of the clips is a cylindrical tube 23 with two open ends 30, 32 that are joined by a ¼ inch wide gap 25. To attach the clip, the clip is held next to the belt loop with the gap vertical and facing toward the edge of the belt loop. The clip is then slid onto the belt loop by passing the loop edge first through the gap. The loop comes to rest in the space within the clip and with the ends of the belt loop passing through the two open ends of the clip. Next the clip is rotated about its axis to position the gap between the belt loop and the pants, so that the gap cannot be seen and the decorative outer surfaces of the clip are visible. The reverse process is used to remove the clip. Once attached, the clips serve to decorate the belt loops. The edges of the metal clip are smooth to reduce the chance of damaging the fabric of the belt loops. A wide variety of materials may be used instead of metal or plastic, including leather, rubber, wood, stone, or glass.

The clip is made by sawing a segment from a long metal tube, cutting a slit to form the gap, and smoothing the cut edges.

A wide variety of other schemes are within the scope of the invention.

Figure 3:
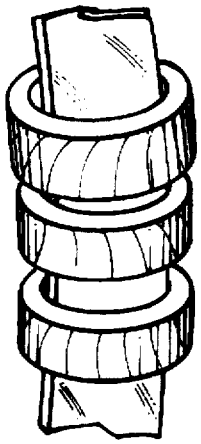
FIGS. 3 through 12 are perspective views of other clips.

For example, the dimensions of the clip may be different. The length may be chosen to suit particular belt loops, e.g., in a range from about ¾ inch to about 2 inches. Shorter clips (including clips even shorter than ¾ inch, e.g., about ½ inch long) may be attached to a belt loop in pairs or groups (FIG. 3). The diameter may be made larger, even much larger, or smaller (as long as it is still capable of being attached to the belt loop) than the first example described above. Diameters in the range of about ⅜ inch to about 1 inch may work especially well. The thickness of the metal may be larger or smaller or may be varied over the length or around the circumference of the clip.

Figure 4:
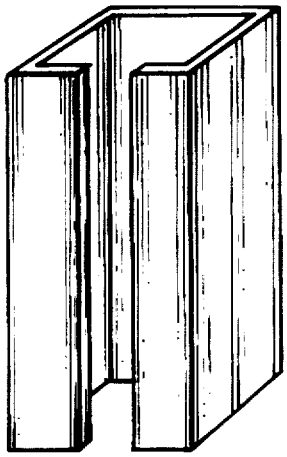
Figure 5:
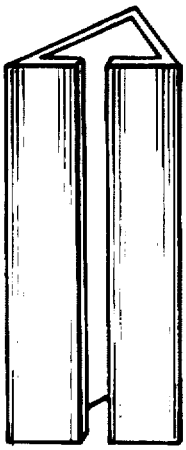
Figure 6:
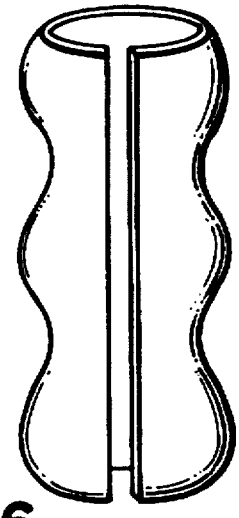
Figure 7:
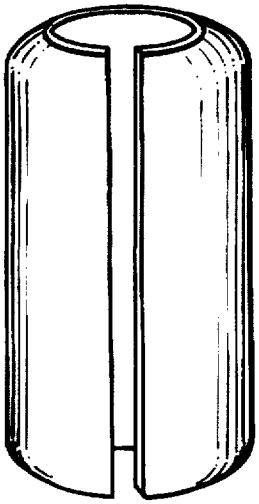

The clip need not be cylindrical. It could have any cross-sectional shape which permits it to be attached to the belt loop, e.g., triangular or square (FIG. 4 or FIG. 5). The cross-sectional configuration need not be uniform along the length of the clip (FIG. 6 and FIG. 7).

Figure 8:
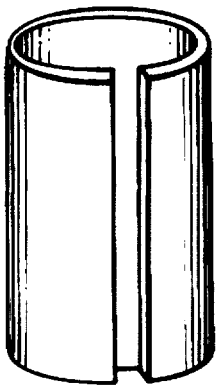
Figure 9:
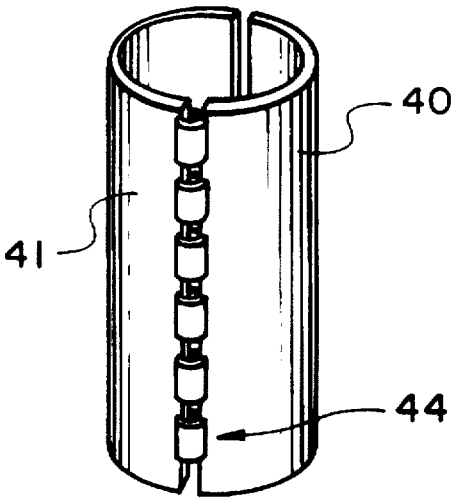
Figure 11:
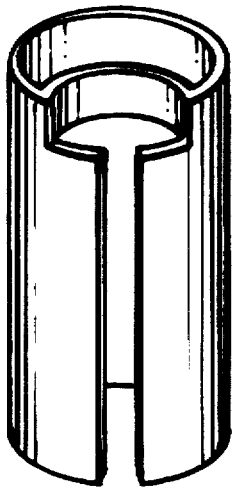
Figure 12:
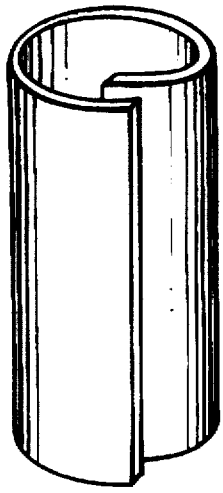

The gap may be larger than ¼ inch if it is not so large that the clip falls off the belt loop, or the gap may be smaller than ¼ inch. By making the clip of a flexible, resilient material (such as a segment of plastic hose), the gap can be made extremely small (FIG. 8). Such a clip may be attached to the belt loop by pulling apart the edges that define the slit. Or the clip could be made with two hinged pieces 40, 42 (FIG. 9). The hinge 44 may be spring loaded to force the two pieces to close together, or magnets could be arranged along the lengths of the two free edges to hold them together. The gap could be formed by configuring the loop as a spiral (FIG. 12). The gap need not run the entire length of the clip but could be stopped short of one end (FIG. 11).

Figure 10:
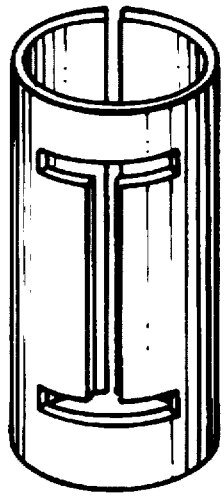

Many different techniques may be used to give a decorative effect to the clip. These techniques include choices of the material, color, surface texture, and overall configuration. The decoration may include patterns or images. The clip, or part of it may be transparent or translucent and a second layer of decoration may be perceived through the transparent or translucent portion. Decorative materials could include holographic films, metallic films, sparkles, ribbons, paint, dyes, fluorescent elements, fabric, embossing, and multiple elements of possibly different sizes and shapes attached to the outer surface of the clip. Holes may be cut in the clip (FIG. 10) to expose a portion of the belt loop.

The clip may be used to decorate other parts of clothing, such as suspenders.

The clip need not be made by cutting a segment of a long tube, but can be formed, for example, by extrusion, molding, machining, milling, casting, welding, or gluing.

The clip could be attached to the clothing by the manufacturer rather than by the user. For example, a pants maker could add metal clips around the belt loops when the belt loops are attached to the pants waist. Such clips could be simple cylinders without slits.

What is claimed is:

1. A method of decorating an item of clothing that includes a closed loop of material disposed on a waist portion of the item of clothing, the closed loop of material being configured to support the item of clothing using a belt or the like, the method comprising providing a decorative device that includes a generally annular surface configured to enclose a space, the annular surface being open at two ends, the annular surface being interrupted by a gap extending from one of the two open ends to the other of the two open ends to permit entry to the enclosed space via the gap, and manipulating a portion of the closed loop disposed at the waist portion of the clothing through the gap to cause it to lie within the space enclosed by the annular surface, other portions of the closed loop extending outside the device, the gap remaining after the portion of the closed loop at the waist portion has been manipulated to lie within the space.

2. The method of claim 1 in which the loop comprises a belt loop.

3. The method of claim 1 further comprising, after the portion of the loop has been manipulated to lie with the space, rotating the device to reposition the gap to impede removal of the device.

4. The method of claim 1 in which the item of clothing comprises pants.

5. The method of claim 1 in which the gap is essentially fixed.

6. A decorative clothing combination comprising an item of clothing that includes a closed loop of material disposed on a waist portion of the item of clothing, the closed loop of material being configured to support the item of clothing using a belt or the like, the method comprising a device for the item of clothing comprising a generally annular surface having a length between about ½ inch and about 2 inches, and configured to enclose a generally cylindrical space having a diameter less than about 1 inch, the cylindrical space being open at two ends, the annular surface being interrupted by a gap extending from one of the two open ends to the other of the two open ends to permit entry to the enclosed space of the closed loop, the gap being as large as ¼ inch and configured to remain after the portion of the closed loop at the waist portion has been manipulated to lie within the space.

7. The decorative clothing combination of claim 6 in which the item of clothing comprises pants.

8. The decorative clothing combination of claim 6 in which the gap is essentially fixed.

9. The device of claim 6 in which the surface is rigid.

10. The device of claim 6 in which the surface is flexible.

11. The device of claim 6 in which the surface comprises metal.

12. The device of claim 6 in which the surface comprises plastic.

13. The device of claim 6 in which the surface is generally cylindrical.

14. The device of claim 6 in which the surface comprises a decorative element.

15. The device of claim 14 in which the decorative element comprises color.

16. The device of claim 14 in which the decorative element comprises patterning.

17. The device of claim 14 in which the decorative element is fluorescent.

18. The device of claim 14 in which the decorative element comprises metal.

19. The device of claim 14 in which the decorative element comprises sparkles.

20. The device of claim 14 in which the decorative element comprises embossing.

21. The device of claim 14 in which the decorative element comprises a coating.

22. The device of claim 14 in which the decorative element comprises fabric.

23. The device of claim 6 in which the enclosed space has a diameter at least about ⅜ inches.

* * * * *